United States Patent [19]

Marino

[11] 4,102,077

[45] Jul. 25, 1978

[54] HOOP AND SELECTIVELY DISENGAGEABLE TRUNDLING APPARATUS

[76] Inventor: Joseph Marino, 5241 NE. 1st Ave., Ft. Lauderdale, Fla. 33334

[21] Appl. No.: 769,678

[22] Filed: Feb. 17, 1977

[51] Int. Cl.[2] ..... A63H 33/02

[52] U.S. Cl. ..... 46/220

[58] Field of Search ..... 46/220, 114; 280/11.37 H

[56] References Cited

U.S. PATENT DOCUMENTS

| | | | |
|---|---|---|---|
| 1,714,448 | 5/1929 | Roth | 46/220 |
| 3,827,180 | 8/1974 | Phillips, Jr. | 46/220 |
| 3,862,765 | 1/1975 | Goheen | 280/11.37 H |

*Primary Examiner*—Louis G. Mancene
*Assistant Examiner*—Mickey Yu
*Attorney, Agent, or Firm*—Robert D. Farkas

[57] ABSTRACT

A hoop and selectively disengagable trundling apparatus includes an elongated rigid bar element having a handle element fixedly secured at one end thereof and a pair of complementary arcuate jaw elements disposed on the other end thereof. The jaw elements are affixed for selective opening, and a hoop dimensioned to rotate within the closed jaw elements, and to be released therefrom when the jaw elements are opened.

4 Claims, 3 Drawing Figures

HOOP AND SELECTIVELY DISENGAGEABLE TRUNDLING APPARATUS

BACKGROUND OF THE INVENTION

1. Field of the Invention

The present invention relates to hoops and trundling apparatuses, and more particularly, to a hoop and a selectively disengagable trundle apparatus.

2. Description of the Prior Art

The amusement potential of propelling a hoop with a pole, handle, or the like is well known. Several devices provide loops or hooks for effective engagement of the hoop to be propelled. The skillful direction of the hoop by these hooks or loops adds to the entertainment value of these devices.

U.S. Pat. No. 1,965,240 issued to M. K. Hill on July 3, 1934 discloses a hoop and a handle having an inwardly biased hook element. After the hoop is placed within the hook and is placed in play, the hoop cannot be disengaged therefrom without the cecessation of the rolling of the hoop.

U.S. Pat. No. 3,535,820 issued to V. L. Thompson on Oct. 27, 1970 teaches a steering pole for hoops which provide a substantially "C" shaped hooked section for engaging a rolling hoop. While the steering pole can be deliberately disengaged from an in motion, hoop the hoop may also accidentially become disengaged since a portion of the hook always remains open.

U.S. Pat. No. 3,827,180 issued to J. T. Phillips, Jr. on Aug. 6, 1974 reveals a hoop propelling pole providing a pair of resilient legs for capturing a hoop. Although the hoop is secured between the legs, it cannot be disengaged while the hoop is in use.

The present invention overcomes the problems associated with the prior art by providing a selectively disengageable trundling apparatus which may be disengaged from a hoop in motion or positively engages the hoop as desired by the user.

SUMMARY OF THE INVENTION

Therefore, a primary object of the present invention is to provide a trundling apparatus for hoops which selectively engages and positively retains or disengages and releases a hoop while in motion.

A further object is to provide selectively disengagable trundling apparatus for hoops which may be used to maneuver and direct a hoop for entertainment.

Another object is to provide a selectively disengagable trundling apparatus for hoops which is simple in design, inexpensive to manufacture and durable.

These objects, as well as further objects and advantages, of the present invention will become readily apparent after reading the description of a non-limiting illustrative embodiment and the accompanying drawing.

A hoop and selectively disengagable trundling device according to the principles of the present invention includes an elongated rigid bar element having first and second ends; a handle element fixedly secured to a first end of the bar element; a pair of complementary arcuate jaw elements disposed on the second end of the bar element, the jaw elements forming an operable capturing loop; opening means for selectively opening the capturing loop disposed adjacent to the bar element; and a hoop dimensioned to be selectively captured by the capturing loop when the jaw elements are in a closed position, and to be selectively disengaged from the capturing loop when the jaw elements are in an open position, the hoop being capable of free rotation about the circumference thereof when within the capturing loop.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
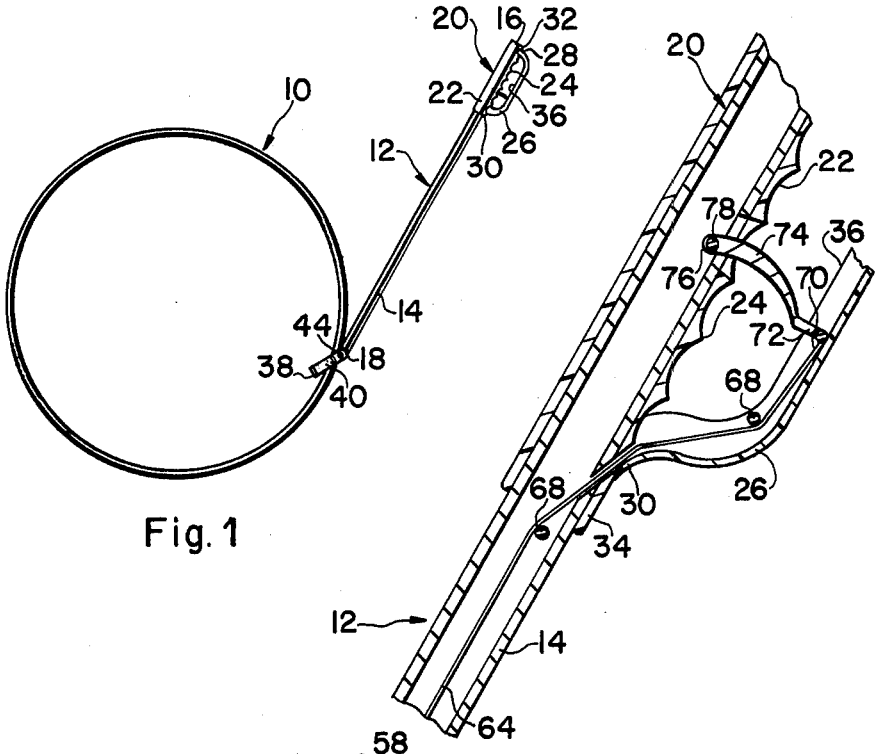
FIG. 1 is a side view in elevation of the preferred embodiment incorporating the principle of the present invention.

Referring now to the Figures, and more particularly to FIG. 1, there is illustrated therein a hoop 10 and a selectively disengagable trundling apparatus 12. The hoop 10 has a circular cross-section and is preferrably about eighty centimeters in diameter. The trundling apparatus 12 includes an elongated hollow rigid bar element 14 having a first end 16 and a second end 18. A handle element 20 is fixedly secured to the first end 16 of the bar element 14 and includes a molded finger engaging portion 22 which provides a plurality of contoured ridges 24. A hollow arcuate bar 26 is fixedly secured on the free ends 28 and 30 thereof, respectively to the free ends 32 and 34 of the molded finger engaging portion 22. The inner surface 36 of the arcuate bar 26 engages the upper surface of the hand of the user to provide a positive grip of the apparatus 12.

A pair of complementary arcuate jaw elements 38 and 40 are disposed on the second end 18 of the bar element 14 as hereinafter described. The jaw elements 38 and 40 form a capturing loop 42 which captures the hoop 10 therein while permitting the free rotation of the hoop 10 about the circumference thereof as further illustrated in FIG. 3.

Figure 2:
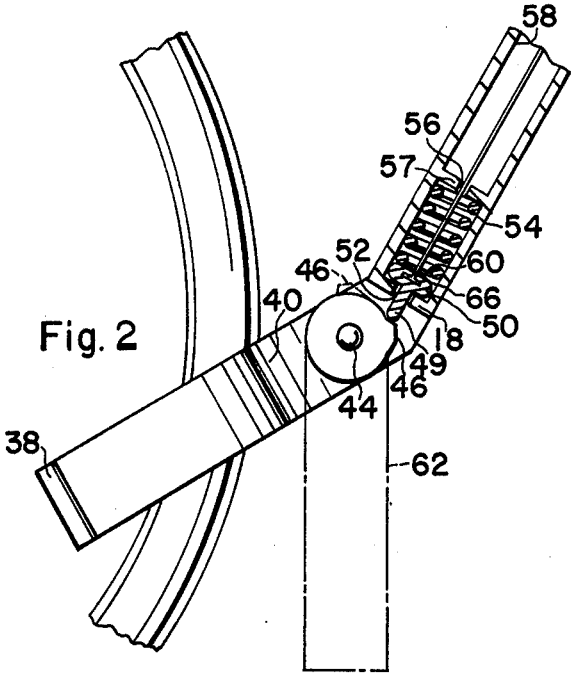
FIG. 2 is a fragmentary side-sectional view of the preferred embodiment.
Figure 3:
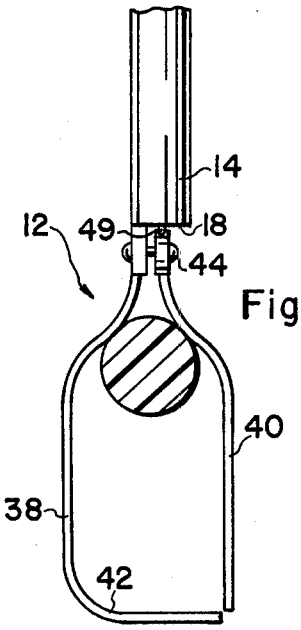
FIG. 3 is a fragmentary front view of the preferred embodiment.

FIG. 2 illustrates a sectional view of the bar element 14 and the handle element 20. The jaw element 38 is fixedly secured to the bar element 14 as shown in FIG. 3. The jaw element 40 is pivotally affixed to the second end 18 of the bar element 14 by a pivot 44. A notch 46 is provided in the end of the jaw element 40. A release element 50 is slidably retained within the hollow bar element 14 and provides an extensive portion 49 which extends through an aperture 52 located therein. The release element 50 is urged into a position extending out of the aperture 52 by a helical coil spring 54 fixedly secured on end 56 thereof to a ridge 57 provided by inner surface 58 of the bar element 14 and the other end 60 thereof in a touching relationship with the release element 50. The extensive portion 49 is captured within the notch 46 thereby maintaining the jaw elements 38 and 40 in a position forming the capturing loop 42. When the release element 50 is withdrawn within the hollow bar element 14 the jaw 40 falls into an open position illustrated by the phantom lines 62 as a result of the force of gravity. When the jaws 38 and 40 are suchly opened the hoop 10 can be released therefrom.

A flexible cable 64 is fixedly secured on a first end 66 thereof to the release element 50 within the hollow bar element 14. The cable 64 extends through the bar element 14 toward the handle element 20 and into the hollow arcuate bar 26 and is supported in a non-binding path by a plurality of pin elements 68. The second end 70 of the cable 64 is fixedly secured to one end 72 of a trigger 74. The other end 76 of the trigger 74 is pivotally affixed by a pivot 78 to the bar element 14. When the trigger 74 is pulled by the user toward the first end 16 of the bar element 14 the release element 50 is thereby withdrawn from the notch 46 and the jaw element 40 opens the capturing loop 42. Although the flexible cable 64 and the release element 50 are illustrated within the hollow bar element, they may alternately be disposed external thereto.

FIG. 3 illustrates the jaws 38 and 40 forming the capturing loop 42 retaining the hoop 10 therein. The jaws 38 and 40 may assume alternate shapes and still be functional if the capturing loop formed thereby permits the free circumferential rotation of the hoop captured therein.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A hoop and selectively disengagable trundling apparatus comprising:

an elongated rigid bar element, having first and second ends;

a handle element fixedly secured to said first end of said bar element;

a pair of complementary arcuate jaw elements disposed on said second end of said bar element, said jaw elements forming an openable capturing loop;

opening means for selectively opening said capturing loop disposed adjacent to said bar element;

a hoop dimensioned to be selectively captured by said capturing loop when said jaw elements are in a closed position, and to be selectively disengaged from said capturing loop when said jaw elements are in an open position, said hoop being capable of free rotation about the circumference thereof when within said capturing loop;

wherein one of said arcuate jaw elements is fixedly secured on a first end thereof to said second end of said rigid bar element, the other said arcuate jaw element being pivotally affixed on a first end thereof to said second end of said rigid bar element, the second ends of each of said arcuate jaw elements falling adjacently and forming a closed capturing loop when in the closed position, the pivoting of said other arcuate jaw element opening said capturing loop and permitting the passage of said hoop between said second ends of said arcuate jaw elements.

2. A hoop and selectively disengagable trundling apparatus as claimed in claim 1, wherein said opening means comprises a trigger pivotally affixed on a first end thereof to said rigid bar element adjacent said handle element, a flexible cable fixedly secured on a first end thereof to the second end of said trigger, a release element slidably affixed adjacent said second end of said elongated rigid bar element, the pivoting of said trigger toward said first end of said bar element urging said release element in the same direction, a notch being provided in said first end of said pivotally affixed arcuate jaw element, said notch for capturing said release element, said release element inserted in said notch maintaining said pivotally affixed arcuate jaw element in a closed position, the withdrawal of said release element from said notch resultant of the pivoting of said trigger causing the opening of said arcuate jaw elements as a result of gravity acting on said pivotally affixed jaw element and the release of said hoop, and bias means for urging said release element into said notch.

3. A hoop and selectively disengagable trundling apparatus as claimed in claim 2, wherein said bias means comprises a helical coil spring, said helical coil spring fixedly secured on one end thereof to said elongated rigid bar element, the other end thereof urging said release element toward said notch.

4. A hoop and selectively disengagable trundling apparatus as claimed in claim 2, wherein said elongated rigid bar element is hollow and forms a longitudinal chamber therein, said flexible cable passing through said longitudinal chamber and said bias means and said release element being disposed therein, said release element being extensible through an aperture located in said second end of said elongated rigid bar element.

* * * * *